US005398754A

United States Patent [19]

Dinhoble

[11] Patent Number: 5,398,754

[45] Date of Patent: Mar. 21, 1995

[54] RETRIEVABLE WHIPSTOCK ANCHOR ASSEMBLY

[75] Inventor: Daniel E. Dinhoble, Houston, Tex.

[73] Assignee: Baker Hughes Incorporated, Houston, Tex.

[21] Appl. No.: 186,267

[22] Filed: Jan. 25, 1994

[51] Int. Cl.[6] ..... E21B 7/06; E21B 23/03

[52] U.S. Cl. ..... 166/117.6; 175/81; 175/82

[58] Field of Search ..... 166/117.5, 117.6, 313; 175/61, 81, 82

[56] References Cited

U.S. PATENT DOCUMENTS

| | | | |
|---|---|---|---|
| 2,797,893 | 7/1957 | McCune et al. | 166/50 X |
| 4,397,360 | 8/1983 | Schmidt | 175/61 |
| 4,765,404 | 8/1988 | Bailey et al. | 166/117.6 |
| 5,012,877 | 5/1991 | Winters et al. | 175/80 |
| 5,035,292 | 7/1991 | Bailey et al. | 175/61 X |
| 5,154,231 | 10/1992 | Bailey et al. | 166/117.6 X |
| 5,287,921 | 2/1994 | Blount et al. | 166/117.6 |
| 5,301,760 | 4/1994 | Graham | 175/61 |
| 5,335,737 | 8/1994 | Baugh | 175/61 |

*Primary Examiner*—Ramon S. Britts
*Assistant Examiner*—Frank S. Tsay
*Attorney, Agent, or Firm*—Fishman, Dionne & Cantor

[57] ABSTRACT

A retrievable whipstock/anchor assembly is used to allow drilling of additional wellbores from an original or primary wellbore (which may be a highly deviated or horizontal open wellbore). The retrievable whipstock assembly is comprised primarily of two sections, an anchor section and a whip stock section. The anchor section provides resistance to compression and rotation forces, and provides rigidity for the whipstock. The whipstock provides a support face for drilling the additional wellbores. The whipstock can be oriented radially to allow drilling at any radial angle, and can be set at any depth. Anchoring of the retrievable whipstock assembly is provided by means of an inflatable element which expands to grip the inside wall of the wellbore. Radial orientation can be provided by rotating the retrievable whipstock assembly from surface or other means until the whipstock is at the desired orientation. Radial orientation can also be provided by an orienting guide in the top of a lower completion into which the retrievable whip stock assembly can be landed. In accordance with an important feature of this invention, the retrievable whipstock assembly is run-in the wellbore using a novel run-in tool while the retrievable whipstock assembly is retrieved from the wellbore by means of a novel retrieving tool, both of which attach to the whipstock. Both the run-in and retrieving tools include a novel cylindrical housing which acts as a protective shroud over the whipstock thereby precluding or minimizing damage during run-in and/or retrieval.

20 Claims, 9 Drawing Sheets

RETRIEVABLE WHIPSTOCK ANCHOR ASSEMBLY

BACKGROUND OF THE INVENTION

This invention relates to whipstock assemblies used in wellbore drilling and completion. More particularly, this invention relates to a new and improved whipstock assembly which is easily retrievable from a downhole location after having been initially run-in and set in a desired downhole location. The retrievable whipstock assembly of this invention may be used as an integral component in downhole operations for completion of a branch wellbore extending laterally from a primary well which may be vertical, inclined or even horizontal. This invention finds particular utility in the completion of multilateral wells, that is, downhole well environments where a plurality of discrete, spaced lateral wells extend from a common vertical wellbore.

Horizontal well drilling and production have been increasingly important to the oil industry in recent years. While horizontal wells have been known for many years, only relatively recently have such wells been determined to be a cost effective alternative (or at least companion) to conventional vertical well drilling. Although drilling a horizontal well costs substantially more than its vertical counterpart, a horizontal well frequently improves production by a factor of five, ten, or even twenty in naturally fractured reservoirs. Generally, projected productivity from a horizontal well must triple that of a vertical hole for horizontal drilling to be economical. This increased production minimizes the number of platforms, cutting investment and operational costs. Horizontal drilling makes reservoirs in urban areas, permafrost zones and deep offshore waters more accessible. Other applications for horizontal wells include periphery wells thin reservoirs that would require too many vertical wells, and reservoirs with coning problems in which a horizontal well could be optimally distanced from the fluid contact.

Also, some horizontal wells contain additional wells extending laterally from the primary vertical wells. These additional lateral wells are sometimes referred to as drainholes and vertical wells containing more than one lateral well are referred to as multilateral wells. Multilateral wells are becoming increasingly important, both from the standpoint of new drilling operations and from the increasingly important standpoint of reworking existing wellbores includes remedial and stimulation work.

As a result of the foregoing increased dependence on and importance of horizontal wells, horizontal well completion, and particularly multilateral well completion have been important concerns and have provided (and continue to provide) a host of difficult problems to overcome. Lateral completion, particularly at the juncture between the vertical and lateral wellbore is extremely important in order to avoid collapse of the well in unconsolidated or weakly consolidated formations. Thus, open hole completions are limited to competent rock formations; and even then open hole completion are inadequate since there is no control or ability to re-access (or re-enter the lateral) or to isolate production zones within the well. Coupled with this need to complete lateral wells is the growing desire to maintain the size of the wellbore in the lateral well as close as possible to the size of the primary vertical wellbore for ease of drilling and completion.

While sealing the juncture between a vertical and lateral well is of importance in both horizontal and multilateral wells, re-entry and zone isolation is of particular importance and pose particularly difficult problems in multilateral wells completions. Re-entering lateral wells is necessary to perform completion work, additional drilling and/ore remedial and stimulation work. Isolating a lateral well from other lateral branches is necessary to prevent migration of fluids and to comply with completion practices and regulations regarding the separate production of different production zones.

The problem of lateral wellbore (and particularly multilateral wellbore) completion has been recognized for many years as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g., re-entry) a lateral subsequent to completion thereof. U.S. Pat. No. 3,330,349 discloses a mandrel for guiding and completing multiple horizontal wells. U.S. Pat. Nos. 4,396,075; 4,415,205; 4,444,276 and 4,573,541 all relate generally to methods and devices for multilateral completions using a template or tube guide head. Other patents of general interest in the field of horizontal well completion include U.S. Pat. Nos. 2,452,920 and 4,402,551.

Whipstocks have been used historically as a means to drill additional sidetracks within a parent wellbore. In some instances, several sidetracks have been drilled and produced through open hole. A difficulty in such use of whipstocks is the requisite need to remove or retrieve the whipstock subsequent to the lateral being drilled so as to allow the lower completion to be connected to the upper lateral completion. This need for retrievable whipstock assemblies is particularly important in view of recently proposed multilateral completion techniques such as described in commonly assigned U.S. application Ser. No. 08/076,391 filed Jun. 10, 1993 which, in some instances, requires the use of a retrievable whip stock in order to connect multilateral completion strings. While retrievable whip stock assemblies have been previously described in, for example, aforementioned U.S. Pat. No. 2,858,107 and U.S. application Ser. No. 08/076,391 as well as U.S. application Ser. No. 07/926,451 filed Aug. 7, 1992 (now U.S. Pat. No. 5,311,936), assigned to the assignee hereof, all of the contents of which are incorporated herein by reference, there is a continuing need for improved retrievable whipstocks which are easily run-in, set and retrieved in a consistent, reliable and cost efficient manner.

SUMMARY OF THE INVENTION

The above-discussed and other problems and deficiencies of the prior art are overcome or alleviated by the novel retrievable whipstock/anchor assembly of the present invention which is used to allow drilling of additional wellbores from an original or primary wellbore (which may be a highly deviated or horizontal open wellbore). The retrievable whipstock assembly is comprised primarily of two sections, the anchor section and whipstock section. The anchor section provides resistance to compression and rotation forces, and provides rigidity for the whipstock. The whipstock provides a support face for drilling the additional wellbores. The whipstock can be oriented radially to allow drilling at any radial angle, and can be set at any depth. Anchoring of the retrievable whipstock assembly is provided by means of an inflatable element which expands to grip the inside wall of the wellbore. Radial orientation can be provided by rotating the retrievable whipstock assembly from surface or other means until the whipstock is at the desired orientation. Radial orientation can also be provided by an orienting guide in the top of a lower completion into which the retrievable whipstock assembly can be landed.

In accordance with an important feature of this invention, the retrievable whipstock assembly is run-in the wellbore using a novel run-in tool while the retrievable whipstock assembly is retrieved from the wellbore by means of a novel retrieving tool, both of which attach to the whipstock. Both the run-in and retrieving tools include a novel cylindrical housing which acts as a protective shroud over the whipstock thereby precluding or minimizing damage during run-in and/or retrieval. Because the whipstock assembly of this invention is retrievable, it can be run into the same wellbore multiple times to drill several additional wellbores at various depths and radial orientations. This also allows completion systems to be run below the retrievable whip stock assembly after it has been used to drill an additional wellbore. The retrievable whipstock assembly can also be run into an additional wellbore (e.g., a first lateral wellbore) to be used to drill other additional wellbores (e.g. second, third, etc. lateral wellbores), provided there is a means for diverting the retrievable whipstock assembly into an additional wellbore.

The retrievable whipstock assembly of this invention is operated as follows:

Running

The retrievable whipstock assembly is initially assembled with the novel running tool in place. The running tool is attached to tubing or drillpipe connected to the surface and comprises a collet mechanism and outer sleeve (e.g., protective shroud). The collet mechanism is attached to a mandrel which runs through the length of the whip stock and is latched to the inside of the anchor section of the retrievable whip stock assembly. The collet mechanism supports axial forces on the retrievable whipstock assembly while running in, and keeps the retrievable whipstock assembly from prematurely releasing.

The outer sleeve covers the whipstock and provides protection for the whip stock and rigidity to the retrievable whipstock assembly while running in. The outer sleeve surrounds a portion of the mandrel and defines an annulus between the sleeve and mandrel. The outer sleeve is rotationally locked to the retrievable whip stock assembly through the whipstock to allow rotation of the retrievable whipstock assembly from the surface, which can aid in running through restricted sections. When assembled, the mandrel is inserted through an axial bore in the whipstock; and the whipstock is positioned in the annulus between the sleeve and mandrel. Because the running tool and retrievable whipstock assembly are open through their centers, fluid can be circulated through the retrievable whipstock assembly while running in to clear debris and also aid in passage through restricted sections.

Setting

Once the retrievable whipstock assembly is at the desired depth and radial orientation, a tripping ball is circulated down the tubing or drill pipe to a ball seat which is below the collet mechanism. Ports in the anchor above the element allow circulation if the bottom of the retrievable whipstock assembly is plugged. Once the ball is seated, fluid is forced to flow into the setting ports for the inflatable element. Before the fluid can be pumped into the element, sufficient pressure must be exerted on an internal check valve to shear a retaining ring and allow the check valve to open.

After desired setting pressure has been applied inside the element, an increased pressure will shear retaining screws which hold an internal mandrel (on the running tool) in place. The mandrel will shift down due to fluid pressure and unsupport the collet from the anchor. Applied pressure in the tubing or drill pipe will rapidly decrease, providing an indication at the surface that the mandrel has shifted. The running tool is then retrieved, leaving the retrievable whipstock assembly properly set in the wellbore. A drilling assembly can now be run and an additional wellbore (e.g., lateral) drilled off of the whipstock.

Retrieving

To retrieve the retrievable whipstock assembly, the novel retrieving tool is run in the wellbore down to the retrievable whipstock assembly. The retrieving tool is run on tubing or drill pipe and comprises a sleeve (e.g., protective shroud), a retrieving guide, and a latching mechanism. The sleeve covers the whip stock and prevents the whip stock from becoming lodged in the wellbore during retrieval. The retrieving guide (preferably a hook shaped flap) will hook over the whipstock while rotating and pull the whipstock into the sleeve. Significantly, the retrieving guide can grasp the whipstock if the whipstock's upper end has been pushed into the wall of the wellbore.

To clear debris from the whipstock, the retrieving tool has milling material on the outside of the retrieving guide. Debris is cleared when fluid is circulated through the retrieving tool while rotating over the whipstock. The latching mechanism automatically align itself as the retrieving tool is rotated down over the whipstock. Once the retrieving tool has been run down to the top of the element, the latching mechanism automatically latches onto the whipstock. Tension applied from the surface pulls through the retrieving tool and whipstock into retaining screws in the anchor. Sufficient tension will shear the retaining screws and shift upward an outer sleeve on the anchor. Once the sleeve is shifted, ports to the setting pressure are opened and the element deflates. The retrievable whipstock assembly is then retrieved from the wellbore.

If the anchor section becomes lodged in the wellbore for any reason, sufficient increased tension from the surface will shear retaining screws which hold the whipstock to the anchor. The whipstock and retrieving tool sleeve can then be retrieved from the wellbore. A fishing tool assembly can be run to retrieve the anchor.

The retrievable whipstock assembly of this invention overcomes many of the deficiencies of the prior art. Use of the retrievable whip stock to drill a lateral above a previously installed completion followed by retrieval of the whipstock to continue the completion process, is a particularly important and advantageous feature.

The above-discussed and other features and advantages of the present invention will be appreciated and understood by those skilled in the art from the following detailed description and drawings.

BRIEF DESCRIPTION OF THE DRAWINGS

Referring now to the FIGURES, wherein like elements are numbered alike in the several drawings.

DESCRIPTION OF THE PREFERRED EMBODIMENTS

The retrievable whipstock anchor assembly of the present invention is generally composed of four separable elements including the whipstock section (FIGS. 4-9), the anchor section (FIGS. 10-13), the run-in tool (FIGS. 14-16), and the retrieving tool (FIGS. 17-20). Each of these components of the present invention will now be described in detail beginning with the whipstock section.

Figure 4:
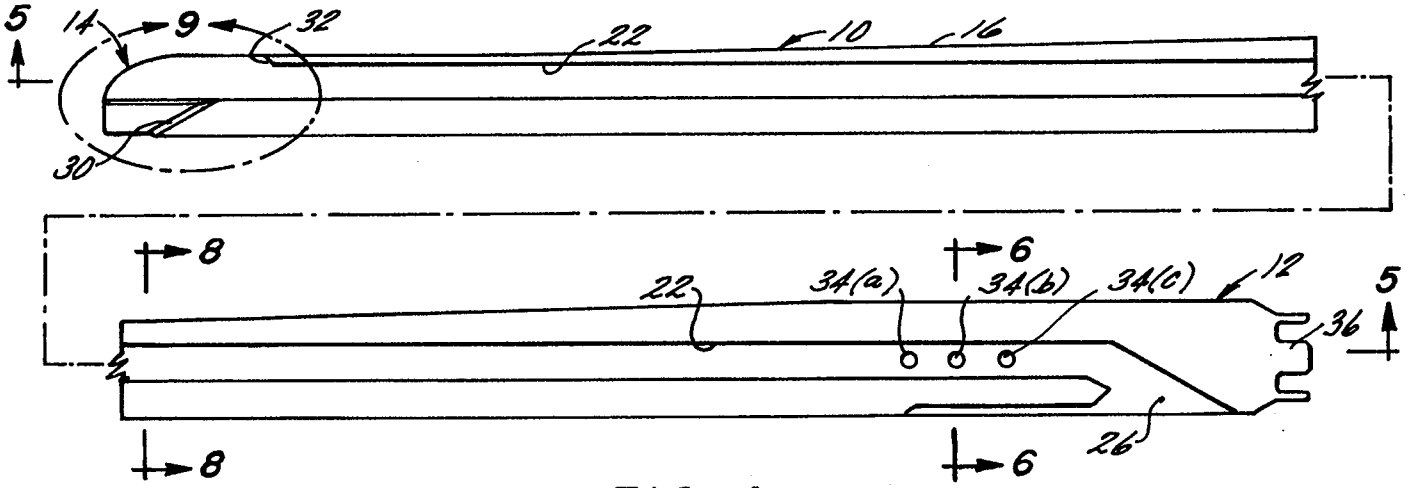
FIG. 4 is a side elevation view of the whipstock section used in the retrievable whipstock assembly of the present invention.
Figure 5:
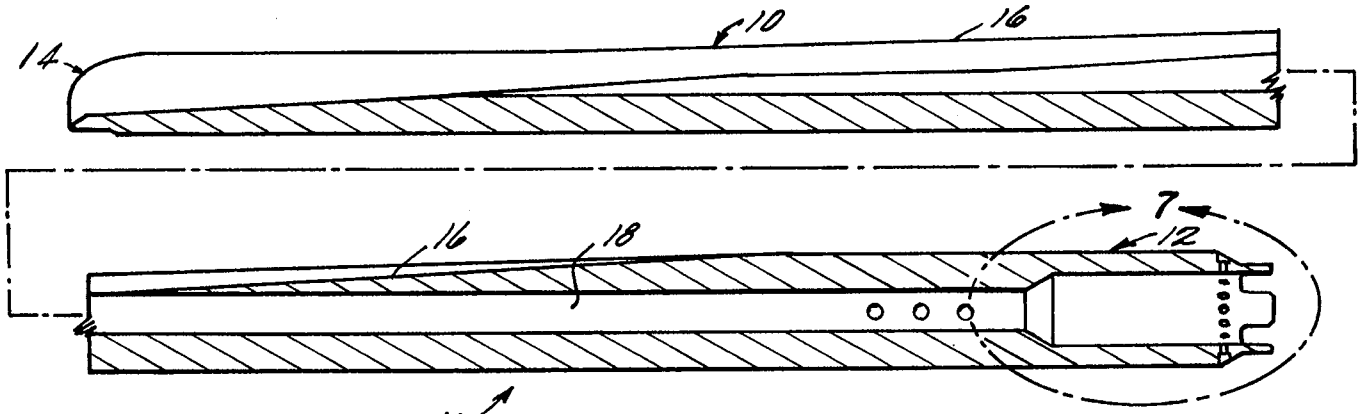
FIGS. 5 and 6 are cross-sectional elevation views respectively along the lines 5—5 and 6—6 of FIG. 4.
Figure 9:
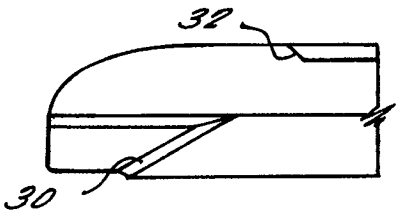
FIG. 9 is an enlarged view of the left hand portion of FIG. 4.
Figure 7:
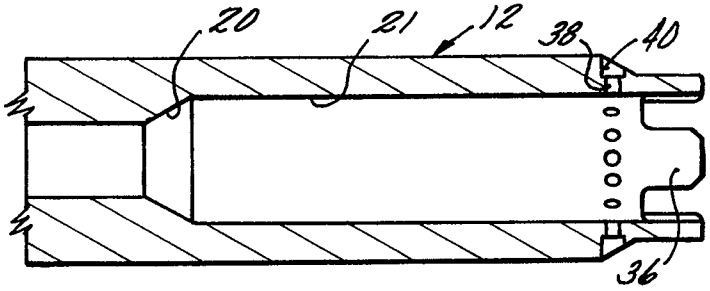
FIG. 7 is an enlarged view of a portion of FIG. 5.
Figure 4A:
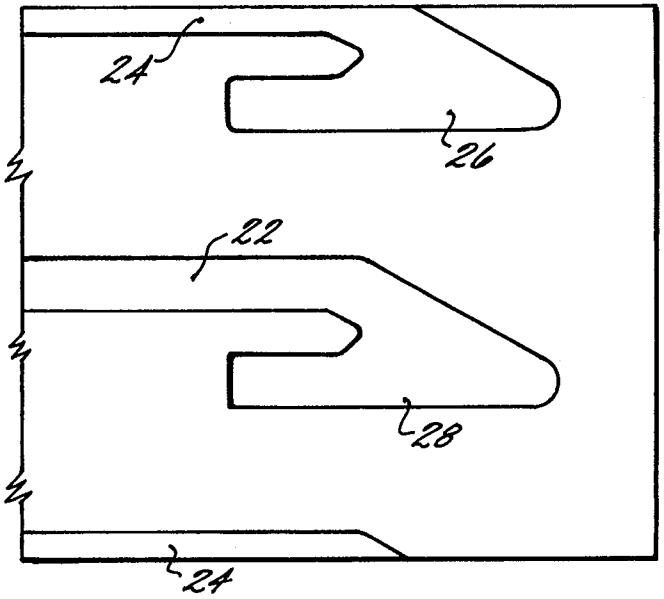
FIG. 4A is a detailed schematic view of the J-slots located on the lower whipstock section.
Figure 8:
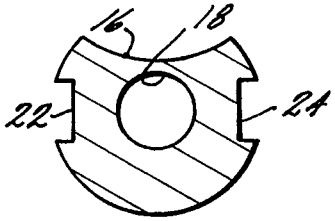
FIG. 8 is a cross-sectional elevation view along the line 8—8 of FIG. 4.
Figure 10:
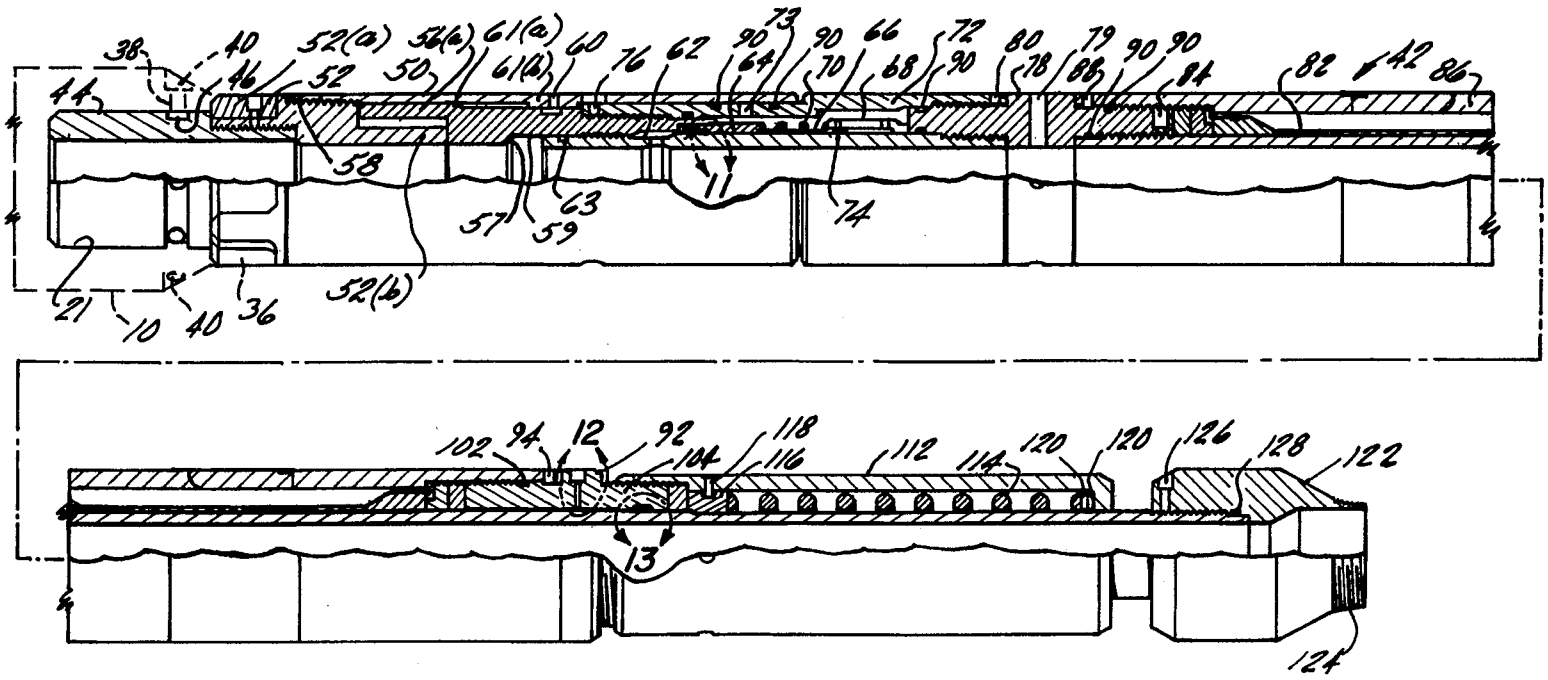
FIG. 10 is a side elevation view, partly in cross-section, of the anchor section of the retrievable whipstock assembly of the present invention.

Referring to FIGS. 4-9, the whipstock section is shown generally at 10 and comprises a preferably machined metal longitudinal element which is generally cylindrical in shape. An arcuate sloped surface 16 runs the entire length of whipstock section 10 and defines the deflection surface for drilling a branch or lateral wellbore as is well known. Whipstock section 10 includes an axial bore 18 which, as best shown in FIG. 5, diverges outwardly from a first smaller diameter to a second larger diameter at a shoulder 20 near the downstream end 12. Referring to FIGS. 4, 4A and 8, on opposed sides of arcuate deflection surface 16 are formed a pair of longitudinal channels 22 and 24 which are disposed in opposing relationship to each other and which extend substantially along the length of whipstock section 10. It will be appreciated that FIG. 4A is a flattened or plan view of the circumference of the lower portion 12 of whipstock 10 where the terminal end of channels 22, 24 are each shown as defining a J configuration or J slot 26, 28, respectively. As best shown in FIG. 9, the entry section 14 of channels 22, 24 include opposed slanted shoulders 30, 32 which act as a lead-in for mating lugs 230 from the retrieving tool (see FIG. 17) to be urged downwardly and received by channels 22, 24 to eventually be landed in J slot 24 and 26 as will be discussed in detail hereinafter.

Figure 6:
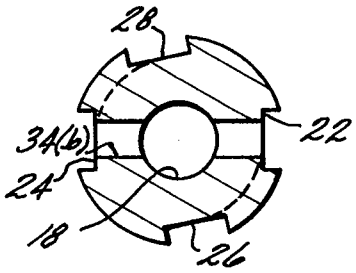

Three aligned through bores 34A, 34B and 34C extend completely through whipstock section 10 and are aligned with the centerline of channels or slots 22, 24 as best shown in FIG. 6. FIG. 6 also depicts the upper sections of each J slot 26, 28. Referring to FIGS. 4, 5 and 7, the lower section 12 of whipstock member 10 defines a splined connection 36 which, as will be discussed hereinafter, mates with a complimentary spline connector on the anchor section. Spline connection 36 comprises a plurality of spaced radial sections which extend outwardly from the outer circumference of whipstock member 10. Upstream and adjacent to spline connection 36 is a plurality of radially in-line openings which include a first bore 38 of a first diameter and a second counterbore 40 of a second, larger diameter than bore 38. These opening are configured to receive a plurality of shear bolts as will be described below.

Referring now to FIGS. 10-13, an anchor section is shown generally at 42. Beginning with the upstream portion of anchor section 42, this upstream section includes an upper extension 44 which is intended to be received in the larger diameter axial bore 21 of whipstock section 10. Extension 44 includes a groove 46 which is sized, configured and positioned to align and match up with each of the radially spaced bores 40 from whipstock section 10. Each bore 40 receives a shear screw 48 which acts to fasten whipstock section 10 to upper extension 44 of anchor section 42. Upper extension 44 is connected to a splined connection 52 having a size and configuration for interdigital engagement with the spline connection 36 in whipstock section 10. Spline connector 52 has spline connectors **52(*a*) and 52(*b*) on opposed longitudinal ends thereof. Extension 44 is threadably connected into spline connector 52. Splined connection 36 from whipstock member 10 is splined into spline connectors 52(*a*) of spline connector 52. A release sleeve 50 is also threaded into spline connector 52 on the end opposite to extension 44. A pick-up sub 56 has splines 56(*a*) which are splined to spline connectors 52(*b*). Each spline from spline connector 52 includes a transverse bore 54 for receiving a set screw for holding together the threaded connection between spline connector 52 and upper extension 44**.

Downstream of spline connector 52 is pick-up sub 56. An internal shoulder 57 is provided along the open axial interior of sub 56 for connection to a collet from the running tool as will be described hereinafter. A release sleeve 50 is positioned along the exterior of anchor section 42 and is threaded onto spline connector 52 (and retained thereto using a plurality of set screws 58). Release sleeve 50 is also connected to pick-up sub 56 using a plurality of radially spaced shear screws 60 which are received in a circumferential groove on sub 56. A pair of aligned, spaced pick-up shoulders 61(*a*) and 61(*b*) are provided between release sleeve 50 and pick-up sub 56. Pick-up sub 56 has an inner diameter 59 which defines a seal surface such that sub 56 is sealingly engaged to an upper mandrel 62. Upper mandrel 62 has an O-ring 63 which is positioned in the inner diameter of sub 56. Upper mandrel 62 supports a check valve poppet 64 which is adjacent to and upstream from a delayed inflate ring 66 and a support ring 68. Delayed inflate ring 66 resides between upper mandrel 62 and spring 70. A check valve spring 70 is positioned between check valve popper 64 and support ring 68. The check valve poppet 64, check valve spring 70 and support ring 68 are surrounded by an outer poppet housing 72. Support ring 68 is attached to delayed inflate ring 66 by a plurality of shear screws 74. Poppet housing 72 is threaded to pick-up sub 56 and a plurality of set screws 76 are used to hold the threaded connection in place. Further downstream of these components is a ported connector 78 having a port 79 transversely therethrough. Connector 78 is threaded to popper housing 72 and retained thereto by a plurality of screws 80 on the upstream side; and on the downstream side, ported connector 78 is threadably attached to a lower mandrel 82 (and retained thereto via a plurality of set screws 84), and to an inflatable element 86 (and retained thereto via a plurality of set screws 88). In addition, ported connector 78 is also threaded, on the upstream end thereof, to upper mandrel 62. The aforementioned components are all selectively provided with appropriate seals such as O-ring seals 90. Check valve poppet 64 is in sealing engagement to upper mandrel 62 preferably using a T shaped seal 92 comprised of a T-seal and back-up rings and best shown in FIG. 11. Sealing engagement is also provided between poppet 64 and pick-up sub 56 as well as between release sleeve 50 and popper housing 72. A port 73 is provided between the two O-rings 90 on the outer diameter of poppet housing 72. Port 73 is normally covered and sealed-off by release sleeve 50.

Figure 12:
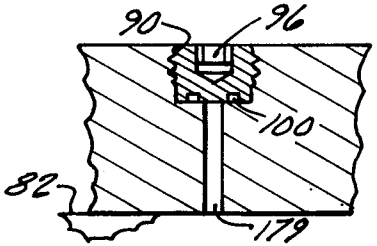
FIGS. 11, 12 and 13 are enlarged, cross-sectional elevation views of detail portions of FIG. 10.
Figure 13:
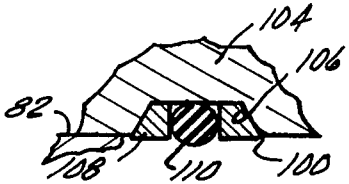
Figure 11:
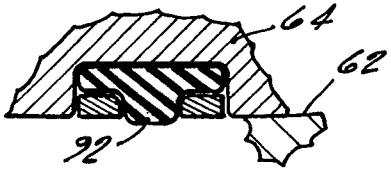

Inflatable element 86 is well known and is generally comprised of a series of rubber sleeves and metal ribs provided onto a standard sub. Element 86 terminates at its downstream end at an element sub 92 and is threadably attached thereto. A plurality of set screws 94 retain element 86 to sub 92. Element sub 92 further has an inverted T-shaped cross-section with the upper portion of the T including a bleeder plug 96 as best shown in FIG. 12. The bleeder plug 96 sits within a bore 98 in element sub 92 and is sealed on its face with an O-ring seal 100. In addition, an O-ring seal 102 seals element sub 92 to inflatable element 86. As best shown in FIG. 13, the lowermost arm 104 of element sub 92 includes a channel 106 having outwardly diverging walls for receiving a pair of backup rings 108 which sandwich an O-ring 110 therebetween. The arrangement shown in FIG. 13 defines a backup seal between element sub 92 and lower mandrel 82.

Downstream of element sub 92 along the exterior of anchor section 42 is a tension housing 112 (which is also threaded to element sub 92) and which is disposed around lower mandrel 82 and captures therebetween an inflatable element spring 114. Element spring 114 bears against a shear ring 116 which is also sandwiched between tension housing 112 and lower mandrel 82. The inner diameter of shear ring 116 also bears against lower mandrel 82. Shear ring 116 is locked to tension housing 112 using a plurality of radially spaced shear screws 118. The lower portion of element spring 114 bears against a pair of spring bearings 120. Lower mandrel 82 is threadably connected to a bottom sub 122 which includes exterior threading 124 for attachment to a lower wellbore completion string and preferably attaches to an orientation anchor downhole of the retrievable whipstock assembly. Bottom sub 122 is further engaged to lower mandrel 82 using a plurality of set screws 126 and is also provided with an O-ring seal 128.

Figure 14:
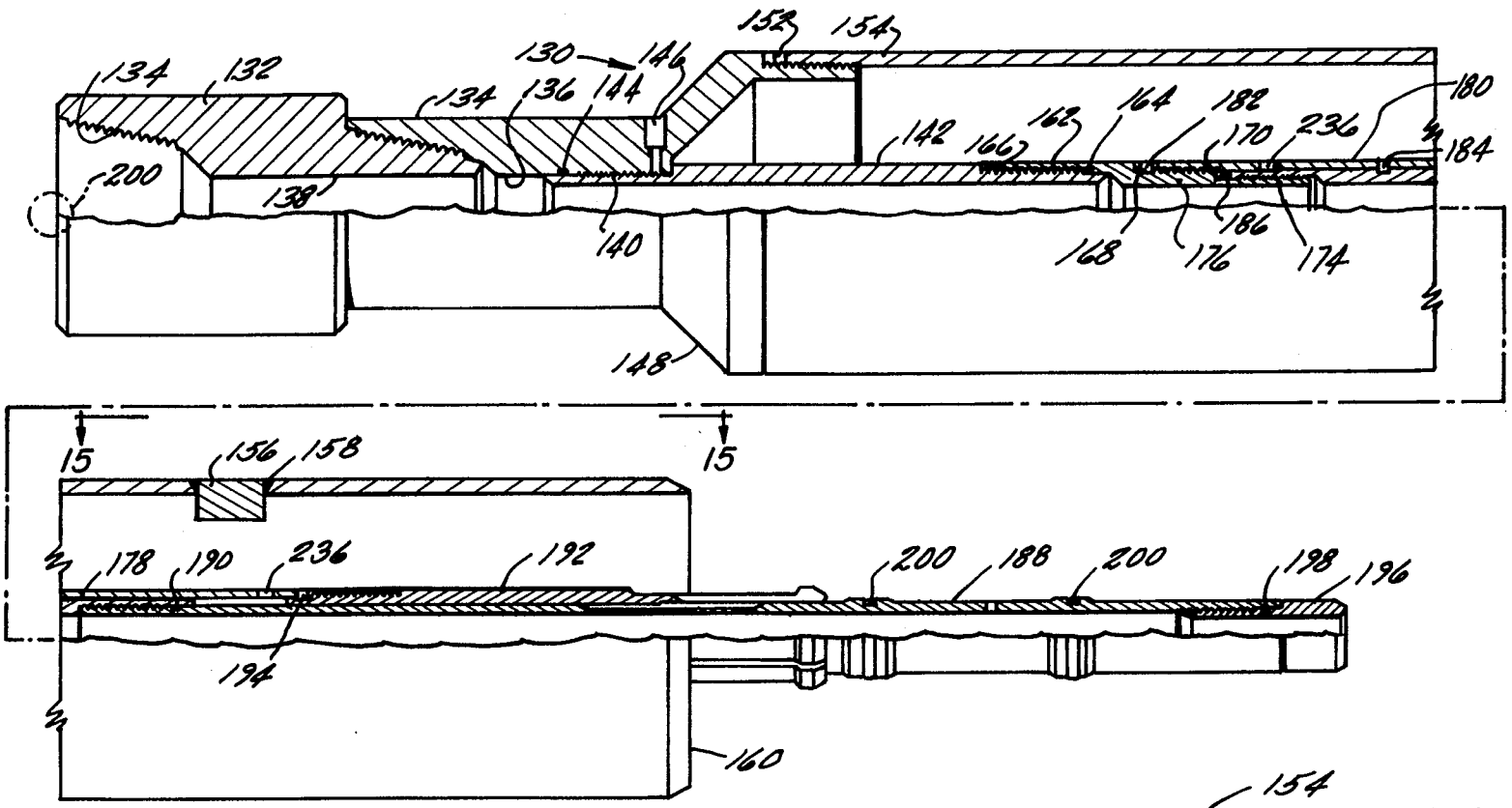
FIG. 14 is a side elevation view, partly in cross-section, of a novel running tool used in conjunction with the retrievable whipstock assembly of the present invention.
Figure 15:
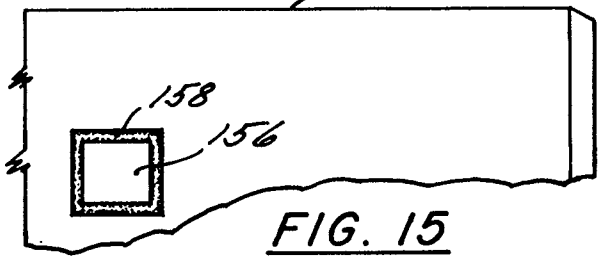
FIG. 15 is a top plan view along the line 15—15 of FIG. 14.

Turning now to FIGS. 14 and 15, the novel running tool shown generally at 130 will now be discussed. Beginning at its upstream end, running tool 130 includes an optional rotary sub 132 having an internal box threading for threadable attachment to drillpipe or similar tubing for stabbing in downhole during run in of the retrievable whipstock assembly. Rotary sub 132 is threadably attached to top sub 134. (It will be appreciated that rotary sub 132 is merely a cross-over sub and is not required since top sub 134 has threading comparable to threading 134 and therefore may be directly attached to drill pipe or the like). Top sub 134 includes an axial bore 136 which communicates with an axial bore 138 in rotary sub 132. Axial bore 136 has internal threading 140 for threadably receiving a lifting sub 142. Lifting sub 142 is sealed to top sub 134 using an O-ring seal 144 and the interengagement is secured using a plurality of set screws 146. The exterior of top sub 134 has an inclined surface 148 defining a skirted annular extension 150. It will be appreciated that an open space or annulus is defined between annular section 150 and lifting sub 142. Threadably attached to annular section 150 and fastened thereto using a plurality of set screws 152 is a running guide 154 which defines a protective housing or shroud for the whipstock section 10 as will be discussed hereinafter. About 9/10th of the way downstream of running guide 154 are a pair of oppositely disposed lugs 156 which are welded into a respective pair of oppositely disposed openings 158 in running guide 154. During assembly, lugs 156 line up with the slots 22, 24 on whipstock section 10 (although these lugs to not engage into the J slot area 26, 28). Running guide 154 terminates downstream at an open end 160 so that, as will be discussed hereinafter, the annulus defined in open end 160 can receive whipstock section 10.

Lift sub 142 is threadably attached at its downstream end to a sealing connector 162 which is sealed to lift sub 142 using an O-ring 164 and the connection is secured by a plurality of set screws 166. Sealing connector 162 includes a pair of spaced shoulders 168, 170. The lower shoulder 170 defines a support surface having a diameter which is smaller than the support surface defined by upper shoulder 168. Support surface 174 on sealing connector 162 is sealingly engaged to a cylindrical release sleeve 178. Release sleeve 178 is sandwiched between sealing connector 162 and a cylindrical housing 180 with a portion of housing 180 being supported by support surface 176. Housing 180 is threadably attached to support surface 176 and is also fastened thereto using a plurality of set screws 182. Housing 180 is similarly fastened to release sleeve 178 using a plurality of shear screws 184. These components are appropriately sealed using O-ring seals 186.

The downstream end of release sleeve 178 is threadably attached to a mandrel 188 and is sealed to release sleeve 178 using an appropriate O-ring seal 190. Mandrel 188 supports a collet 192 on the exterior circumference thereof with collet 192 extending from the interior of running guide 152 outwardly of end 160 as shown in FIG. 14. Collet 192 is threadably attached to housing 180 and secured using a plurality of set screws 194. It will be appreciated that the upstream end of collet 192 is captured between housing 180 and mandrel 188. Threadably attached to the downstream end of mandrel 188 is a ball seat 196.

An O-ring seal 198 is in sealing engagement between ball seat 196 and mandrel 188. Between collet 192 and ball seat 196 is a pair of spaced O-ring seals 200 for sealing engagement with the axial bore 18 of mandrel section 10 as will be discussed hereinafter. It will be appreciated that all of the internal components of running tool 130 including lift sub 142, sealing connector 162, release sleeve 178, mandrel 188 and ball seat 196 have an axial or longitudinal opening therethrough to allow the flow of fluids completely through running tool 130 between bore 138 and ball seat 196. As will be discussed hereinafter, the provision of an axial bore running through running tool 130 is important as it permits a ball (identified at 200 adjacent to rotary sub 132) to pass completely through running tool 130 and to be seated and retained by ball seat 196.

Figures 16, 17, 17A:
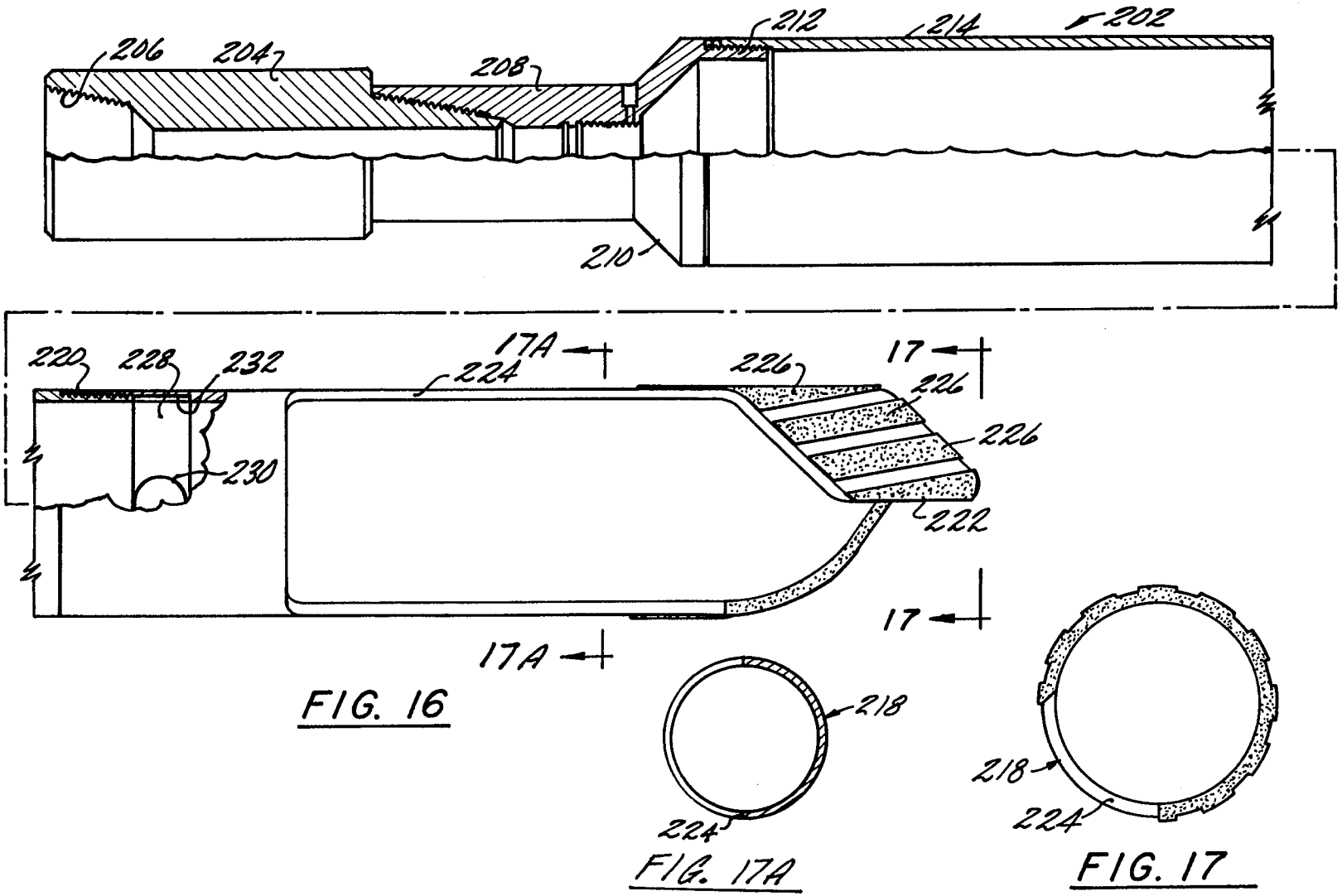
FIG. 16 is a side elevation view, partly in cross-section, of a novel retrieving tool used in conjunction with the retrievable whipstock assembly of the present invention.
FIG. 17 is a right end view taken along the line 17—17 of FIG. 16.
FIG. 17A is a cross-sectional elevation view along the line 17A—17A of FIG. 16.
Figure 18:
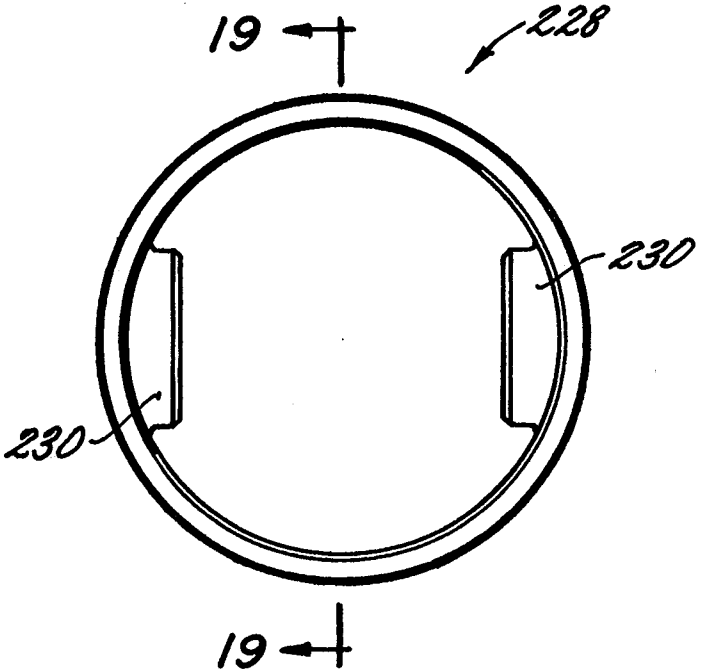
FIG. 18 is a from elevation view of a lug ring used in the retrieving tool of FIG. 16.

Referring now to FIGS. 16–19, a novel retrieving tool used with the retrievable whip stock anchor assembly of the present invention will now described. Retrieving tool is shown generally at 202 and includes, at its upstream end thereof, an optional rotary sub 204 which is similar to rotary sub 132 used in running tool 130. Rotary sub 204 includes internal box threading 206 which is used to threadably mate with drillpipe or the like when retrieving tool 202 is stabbed in downhole. Rotary sub 204 is threadably connected to a top sub 208. As in rotary sub 132, rotary sub 204 is merely a crossover sub and is not required since top sub 208 can attach directly to drill pipe or the like for run-in downhole. Top sub 208 is similar in construction to top sub 134 of running tool 130 and includes an outwardly diverging skirt section 210 and an extending annular section 212. Threadably mated to extension 212 is a retrieving guide 214. A plurality of set screws 216 are used to enhance the threadable connection between retrieving guide 214 and top sub 208. Retrieving guide 214 comprises an open cylindrical housing or shroud and is threadably connected at its downstream end to a wallhook washover shoe 218. A plurality of radially spaced set screws 220 are again used to enhance the connection between washover shoe 218 and retrieving guide 214. Washover shoe 218 comprises a substantially cylindrical housing having dimensions corresponding to the dimensions of retrieving guide 214. The downstream end of washover shoe 218 terminates at a partially wrapped flap or hook 222. As shown in FIGS. 17 and 18, washover shoe 218 has a longitudinal window 224 which, in cross-section, constitutes a semicylindrical open or through section removed from washover shoe 218 as shown in FIG. 18A. The exterior surface of hook 222 includes spaced radial segments of milling material 226 which is preferably comprised of carbide enhanced alloy. As will be discussed hereinafter, wallhook washover shoe 218 is rotated to the right such that hook 222 contacts and moves over whipstock section 10 with milling material acting to remove debris encountered by shoe 218. The opening or trough 224 acts to pull the whip stock within retrieving tool 202 during rotation.

Figure 19:
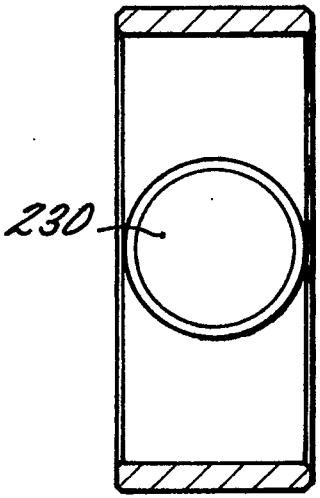
FIG. 19 is a cross-sectional elevation view taken along the line 19—19 of FIG. 18.

At the intersection between retrieving guide 214 and washover shoe 218 is a lug ring 228 which is best shown in FIGS. 19 and 20. Lug ring 228 comprises a cylindrical housing having a pair of oppositely disposed lugs 230 which extend radially towards each other along the inner diameter of lug ring 228. Lug ring 228 is received in an annular groove 232 cooperatively formed by the end of retrieving guide 214 and a shoulder along washover shoe 218. In addition, lug ring 228 freely rotates inside annular surface 232 so that, as will be described hereinafter, lugs 230 will automatically line up with the slots 22, 24 on whipstock section 10 and will, in turn, automatically be urged into the J sections 26, 28 for eventual retrieval of the whipstock and anchor.

Figure 1:
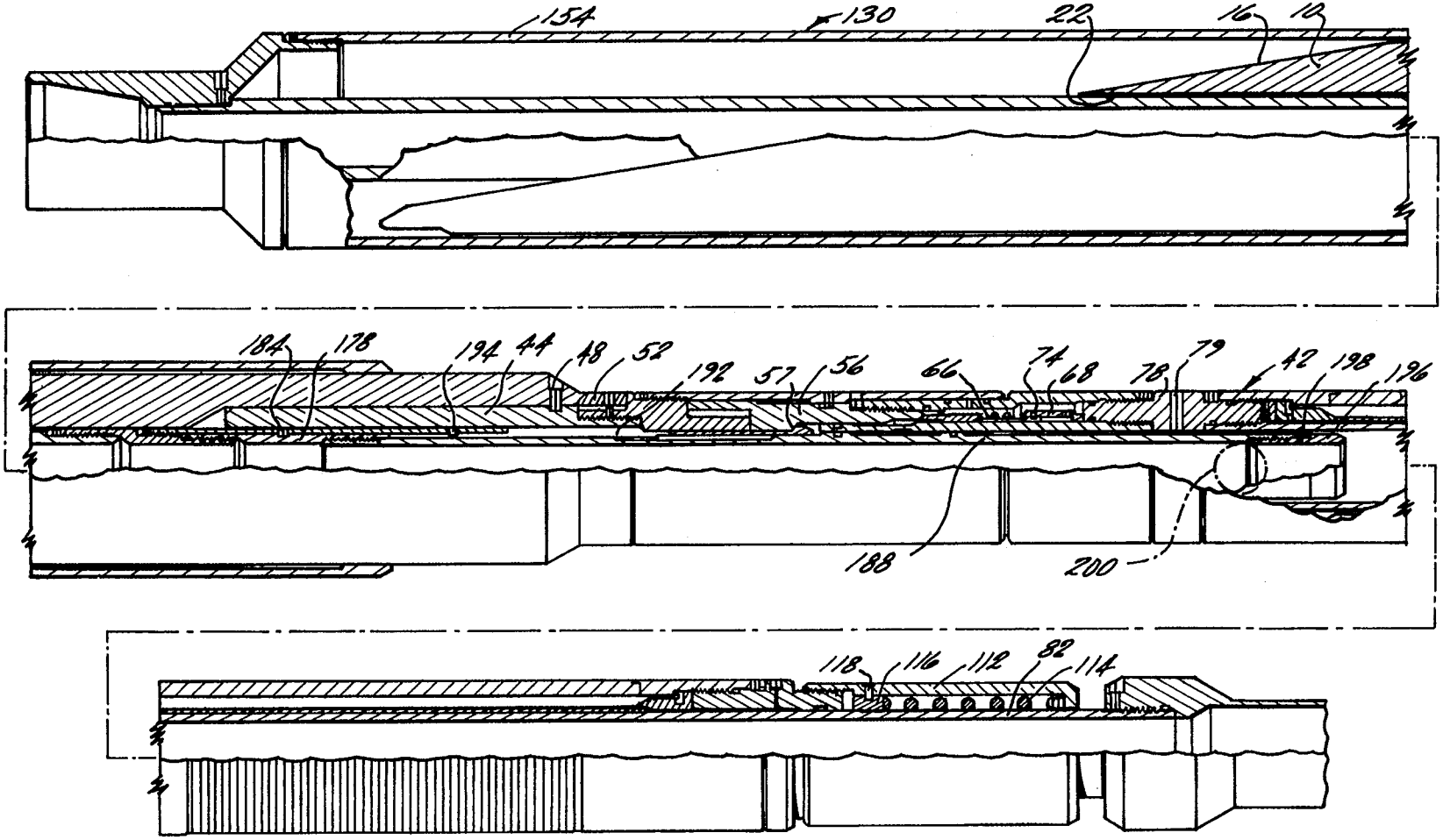
FIGS. 1-3 are cross-sectional elevation views of the retrievable whipstock assemblies respectively depicted in the run-in position, set position and retrieve position.

The operation of the retrievable whipstock anchor assembly of the present invention will now be discussed with reference to FIGS. 1–3. Referring first to FIG. 1, it will be appreciated that the whipstock section 10 and anchor 42 have been assembled by mating the mutual spline connections and the shear screws as was discussed and shown with regard to the left-hand portion of FIG. 10. The running tool 130 is attached to tubing or drillpipe (not shown) at threading 134 for stab-in downhole. Running tool 130 is also attached to the whipstock/anchor assembly by directing the mandrel 188 into axial bore 22 of whipstock section 10 and further sliding tool 130 downwardly such that running guide 154 fully surrounds and protects whipstock 10, and housing 180 in lifting sub 142 is fully engaged within axial bore 22 as shown in FIG. 1. It will be appreciated that as lifting sub 130 is forced downwardly into engagement with whipstock 130, the collet mechanism consisting of collet 192 and release sleeve 178 will engage the shoulder 57 on pick-up sub 56 of anchor section 42. Thus, the collet mechanism (which runs through the whipstock when the running tool 130 is positioned thereon) will latch to the inside of the anchor section 42. Significantly, the collet mechanism supports axial forces on the retrievable whipstock anchor while running in, and keeps the retrievable whipstock anchor from prematurely releasing by holding sub 56 and connector 52 together (note shoulder on ID of connector 52 and matching shoulder on collet 192).

An important feature of this invention is the running guide 154 which houses or covers whipstock 10 and provides protection for the whipstock and rigidity to the retrievable whipstock anchor while running in. Running guide 154 is rotationally locked to the retrievable whipstock anchor to allow rotation of the retrievable whipstock anchor from the surface, which can aid in running through restricted sections. Because the running tool 130 and the retrievable whipstock 10/anchor 42 are open through their centers, fluid can be circulated through the retrievable whipstock anchor while running in to clear debris and also aid in passage through restricted areas.

Once the retrievable whipstock anchor is at the desired depth and radial orientation, a tripping ball 200 is circulated down the tubing or drillpipe to ball seat 196 which, as shown in FIG. 1, is below the collet mechanism. Ports 179 (see FIG. 12) above the inflatable element 86 allow circulation if the bottom of the retrievable whipstock anchor 47 is plugged. Once ball 200 is seated as shown in FIG. 1, fluid is forced to flow into the setting ports for inflatable element 86. However, before the fluid can be pumped into element 86, sufficient pressure must be exerted on internal check valve 64 to shear shear screws 74 which are connected to delayed inflate ring 66 and thereby allow check valve 64 to open.

Figure 2:
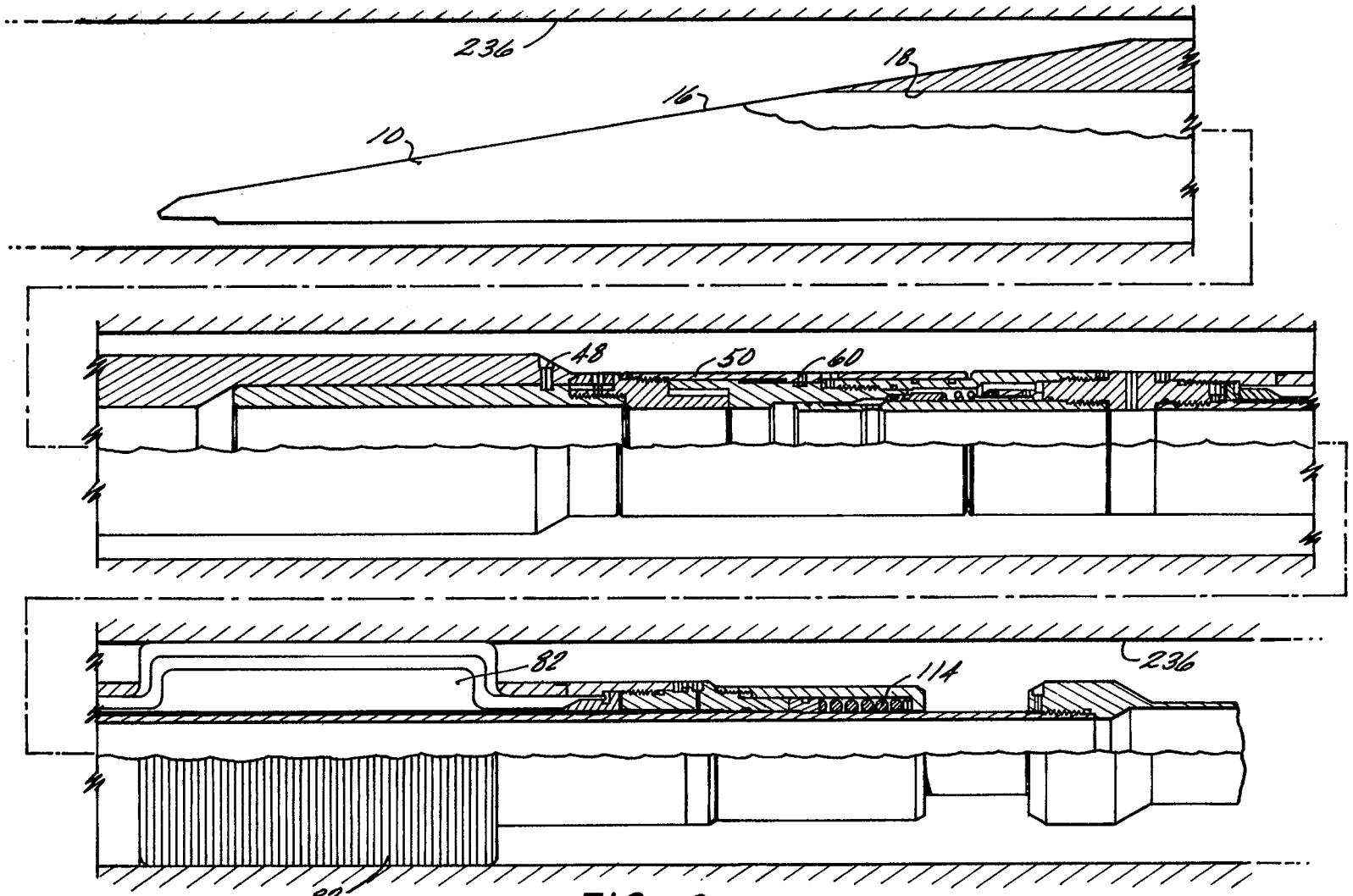

Referring now to FIG. 2, the whipstock anchor assembly is set by applying the desired setting pressure inside elements 86. An increase pressure will shear shear retaining screws 118 which hold tension housing 112 in place. Housing 112 will then shift up and thereby unsupport the collet 192 off of shoulder 57. As a result, applied pressure in the tubing or drillpipe will rapidly decrease providing an indication at surface that the mandrel 188 has shifted as shown in FIG. 2. Running tool 130 is then retrieved since collet 192 is no longer latched to anchor section 42 by pulling upwardly on the tubing or drillpipe thereby leaving the retrievable whipstock anchor properly set in the wellbore 236. Of course, when running tool 130 is removed, whipstock section 10 and its inclined surface 16 will be exposed for guidance of a drill or the like. Thus, a drilling assembly can now be run in and an additional wellbore drilled off of whipstock 10.

Figure 3:
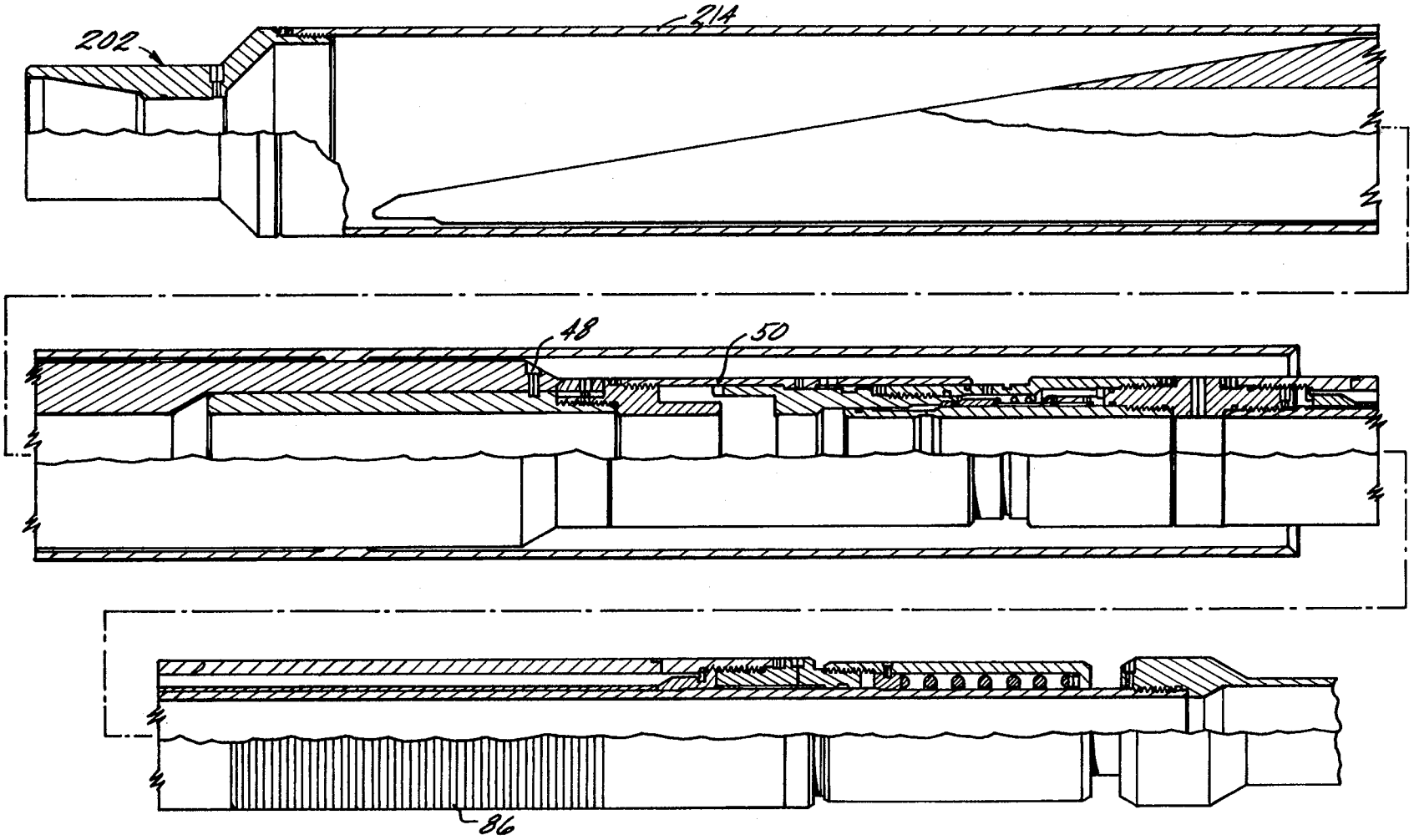

Referring now to FIG. 3, the retrieving operation of the whipstock anchor will now be described. It will be appreciated that in FIG. 3, a simplified and less preferred embodiment (relative to the embodiment of FIG. 16) of retrieving tool 202 is being shown for ease of discussion. During the retrieval operation, retrieving tool 202 is run into the wellbore down to the retrievable whipstock anchor. Retrieving tool 202 is run on tubing or drillpipe (not shown) and the retrieving guide or hook 222 will hook over whipstock section 10 while rotating and pull whipstock 10 into the sleeve or retrieving guide 214. Retrieving guide 222 has the ability to grasp whipstock 10 even if the whipstock's upper end has been pushed into the wall of the wellbore. In a manner similar to running tool 130, retrieving guide 214 of retrieving tool constitutes an important feature of this invention and covers whipstock 10 thereby preventing the whipstock from becoming lodged in the wellbore during retrieval. In order to clear debris from whipstock section 10, retrieving tool 202 utilizes milling material 226 on the outside of retrieving guide 222. Debris is cleared when fluid is circulated to the retrieving tool while rotating over the whipstock. The aforementioned lug ring 228 constitutes a latching mechanism which automatically aligns itself as retrieving tool 202 is rotated down over the whipstock. Once the retrieving tool has been run down to the top of the element, the lug ring automatically latches onto the whipstock. This is accomplished by having the lugs 230 engage with and follow downwardly along the slots 22, 24 until lugs 230, 232 bottom out whereby the lugs will then follow the J portions 26, 28 and engage to the upper bearing surfaces of the J slots.

Tension from the surface pulls through retrieving tool 202 and whipstock section 10 into retaining shear screws 60 and release sleeve 50. Sufficient tension will shear retaining screws 60 causing release sleeve 50 to shift upwardly on anchor 42 as can be shown by a comparison of sleeve 50 between FIGS. 2 and 3. Once sleeve 50 is shifted, ports 73 on poppet housing 72 are open and the element 86 is allowed to deflate. The retrievable whipstock anchor is then retrieved from the wellbore by pulling up on retrieving tool 202.

In accordance with still another important feature of this invention, if anchor section becomes lodged in the wellbore for any reason, sufficient increased tension from the surface will shear retaining screws 48 which hold whipstock section 10 to anchor section 42. The whipstock in retrieving tool 202 can then be retrieved from the wellbore and a fishing tool assembly can then be run to retrieve anchor 42 using well known fishing techniques.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A retrievable whipstock anchor assembly comprising:

(a) a whipstock section having opposed first and second ends and comprising a cylindrical housing and further including;
  (1) a longitudinal bore through said whipstock section;
  (2) a longitudinal diverting surface along at least a portion of said whipstock section;
  (3) first whipstock connection means on the exterior of said whipstock section for mating with a retrieving tool; and
  (4) second whipstock connection means on said second end of said whip stock section;

(b) a cylindrical anchor section having a longitudinal bore in fluid communication with the longitudinal bore from said whipstock means and further including:
  (1) an inflatable element on an exterior portion of said anchor section adapted for selective inflation against the walls of a wellbore;
  (2) first actuating means for inflating said inflatable element;
  (3) second actuating means for deflating said inflatable element;
  (4) first anchor connection means on the interior of said anchor means for mating with a running tool; and
  (5) second anchor connection means on the exterior of said anchor means for mating with said second whipstock connection means and thereby connecting said whip stock section to said anchor section.

2. The assembly of claim 1 including a running tool, said running tool comprising:

a cylindrical housing having an axial opening therethrough;

an inner mandrel extending axially outwardly from said housing and having an outer diameter which is smaller than the diameter of said housing, said inner mandrel having an axial opening therethrough in fluid communication with the axial opening in said housing, said inner mandrel being received in said longitudinal bores of said whipstock section and said anchor section;

detachable mating means on said inner mandrel for detachable mating with said first anchor connection means.

3. The assembly of claim 2 including:

a cylindrical running guide extending outwardly from said cylindrical housing and coaxially surrounding said inner mandrel to define an annulus between said inner mandrel and said running guide, said running guide being disposed over said diverting surface of said whipstock section to thereby protect said whipstock section.

4. The assembly of claim 2 wherein said detachable mating means comprises:

collet sleeve means surrounding a portion of said inner mandrel.

5. The assembly of claim 1 including a retrieving tool, said retrieving tool comprising:

a cylindrical housing having an opening therethrough, said housing having an inner diameter which is sized such that housing is disposed surroundingly over said whipstock section and thereby protects said whipstock section; and retrieval means on the interior of said cylindrical housing for mating with said first whip stock connection means.

6. The assembly of claim 5 wherein:

said housing terminates at a hooked section.

7. The assembly of claim 6 including:

a window in said housing extending from said hooked section, said window having a semi-cylindrical cross-section.

8. The assembly of claim 6 including:

milling material on the outer surfaces of said hooked section.

9. The assembly of claim 5 wherein said retrieval means comprises:

a ring rotatable along the inner diameter of said housing; and at least one lug extending radially outwardly from an inner diameter of said ring.

10. The assembly of claim 9 wherein said first whipstock connection means comprises:

at least one longitudinal slot along the length of said whipstock section terminating in a "J" configuration, said lug being sized to engage said slot and be retained by said "J" configuration.

11. The assembly of claim 1 wherein:

each of said second whipstock connection means and second anchor connection means comprise interlocking detachable spline connectors.

12. The assembly of claim 1 including:

shear connecting means for normally connecting said whipstock section to said anchor section, said shear connecting means including shearing means, which, when sheared, permit disengagement between said whipstock and anchor sections.

13. A running tool for running in a completion tool, comprising:

a cylindrical housing having an axial opening therethrough;

an inner mandrel extending axially outwardly from said housing and having an outer diameter which is smaller than the diameter of said housing, said inner mandrel having an axial opening therethrough in fluid communication with the axial opening in said housing, said inner mandrel adapted for being received in a longitudinal bore of a completion tool;

detachable mating means on said inner mandrel for detachable mating with said connection means on the completion tool.

14. The running tool of claim 13 including:

a cylindrical running guide extending outwardly from said cylindrical housing and coaxially surrounding said inner mandrel to define an annulus between said inner mandrel and said running guide, said running guide adapted for being disposed over at least a portion of the completion tool to thereby protect the completion tool.

15. The running tool of claim 13 wherein said detachable mating means comprises:

collet sleeve means surrounding a portion of said inner mandrel.

16. A retrieving tool for retrieving a completion tool, comprising:

a cylindrical housing having an opening therethrough, said housing having an inner diameter which is sized such that housing is disposed surroundingly over the completion tool to be retrieved and thereby protects the completion tool; and retrieval means on the interior of said cylindrical housing for mating with connection means on the completion tool.

17. The retrieving tool of claim 16 wherein:

said housing terminates at a hooked section.

18. The retrieving tool of claim 17 including:

a window in said housing extending from said hooked section, said window having a semi-cylindrical cross-section.

19. The retrieving tool of claim 17 including:

milling material on the outer surfaces of said hooked section.

20. The retrieving tool of claim 16 wherein said retrieval means comprises:

a ring rotable along the inner diameter of said housing; and at least one lug extending radially outwardly from an inner diameter of said ring.

* * * * *